US009206648B2

(12) United States Patent
Dewey et al.

(10) Patent No.: US 9,206,648 B2
(45) Date of Patent: Dec. 8, 2015

(54) CEMENTING WHIPSTOCK APPARATUS AND METHODS

(71) Applicant: SMITH INTERNATIONAL, INC., Houston, TX (US)

(72) Inventors: Charles H. Dewey, Houston, TX (US); John E. Campbell, Houston, TX (US); Shantanu N. Swadi, Cypress, TX (US); Philip M. Gregurek, Pearland, TX (US)

(73) Assignee: Smith International, Inc., Houston, TX (US)

( * ) Notice: Subject to any disclaimer, the term of this patent is extended or adjusted under 35 U.S.C. 154(b) by 279 days.

(21) Appl. No.: 13/772,165

(22) Filed: Feb. 20, 2013

(65) Prior Publication Data

US 2013/0213654 A1 Aug. 22, 2013

Related U.S. Application Data

(63) Continuation-in-part of application No. 13/085,586, filed on Apr. 13, 2011, now Pat. No. 8,820,437.

(60) Provisional application No. 61/601,354, filed on Feb. 21, 2012, provisional application No. 61/325,068, filed on Apr. 16, 2010.

(51) Int. Cl.

| | |
|---|---|
| ***E21B 7/06*** | (2006.01) |
| ***E21B 33/13*** | (2006.01) |
| ***E21B 23/04*** | (2006.01) |
| ***E21B 33/14*** | (2006.01) |

(52) U.S. Cl.

CPC ..... *E21B 7/061* (2013.01); *E21B 23/04* (2013.01); *E21B 33/13* (2013.01); *E21B 33/14* (2013.01)

(58) Field of Classification Search

CPC ..... E21B 7/061; E21B 29/06; E21B 33/14; E21B 34/14

See application file for complete search history.

(56) References Cited

U.S. PATENT DOCUMENTS

| | | | | |
|---|---|---|---|---|
| 2,509,144 | A | 5/1950 | Grable et al. | |
| 3,997,006 | A * | 12/1976 | Wetzel | 166/377 |
| 4,765,404 | A | 8/1988 | Bailey et al. | |
| 5,154,231 | A | 10/1992 | Bailey et al. | |
| 5,318,132 | A | 6/1994 | Odorisio | |
| 5,437,340 | A | 8/1995 | Lee et al. | |
| 5,443,129 | A | 8/1995 | Bailey et al. | |
| 5,695,009 | A * | 12/1997 | Hipp | 166/196 |
| 5,762,143 | A | 6/1998 | Comeau et al. | |
| 5,806,596 | A | 9/1998 | Hardy et al. | |
| 6,053,250 | A | 4/2000 | Echols | |
| 6,116,336 | A * | 9/2000 | Adkins et al. | 166/55.7 |
| 6,167,970 | B1 | 1/2001 | Stout et al. | |
| 6,334,487 | B1 | 1/2002 | Adkins et al. | |
| 6,923,256 | B2 * | 8/2005 | Parker | 166/242.7 |

(Continued)

OTHER PUBLICATIONS

"Nominal", The Free Dictionary, http://www.thefreedictionary.com/nominal, printed May 21, 2015.*

International Preliminary Report on Patentability with Written Opinion of the International Searching Authority for International Application No. PCT/US2011/032224, Daejeon, South Korea, Oct. 25, 2011, pp. 1-6.

(Continued)

*Primary Examiner* — Jennifer H Gay

(57) ABSTRACT

A system and method facilitate sidetracking by eliminating one or more trips downhole. A sidetracking system includes a whipstock assembly and a stinger assembly. The stinger assembly has a stinger which extends at least partially through the whipstock assembly. The stinger is coupled to a sub of the sidetracking system by a releasable latch mechanism, such as a shear pin or collet.

21 Claims, 6 Drawing Sheets

(56) References Cited

U.S. PATENT DOCUMENTS

| | | | | |
|---|---|---|---|---|
| 7,077,212 | B2 | 7/2006 | Roesner et al. | |
| 7,086,481 | B2 | 8/2006 | Hosie et al. | |
| 7,650,946 | B2 | 1/2010 | Gazewood | |
| 8,820,437 | B2 * | 9/2014 | Ervin et al. | 175/61 |
| 2003/0070815 | A1 | 4/2003 | Sullaway et al. | |
| 2004/0055755 | A1 | 3/2004 | Roesner et al. | |
| 2005/0087338 | A1 * | 4/2005 | Parker | 166/242.6 |
| 2008/0099210 | A1 * | 5/2008 | Gazewood | 166/377 |
| 2011/0253387 | A1 | 10/2011 | Ervin | |
| 2011/0315371 | A1 | 12/2011 | Khodayar et al. | |
| 2012/0000673 | A1 | 1/2012 | Hogan et al. | |
| 2013/0213654 | A1 * | 8/2013 | Dewey et al. | 166/285 |
| 2014/0338908 | A1 * | 11/2014 | Ervin | 166/285 |

OTHER PUBLICATIONS

International Search Report for International Application No. PCT/US2011/032224, Daejeon, South Korea, Oct. 25, 2011, pp. 1-3.

Written Opinion of the International Searching Authority for International Patent Application No. PCT/US2011/032224, Daejeon, South Korea, Oct. 25, 2011, pp. 1-5.

International Search Report for International Application No. PCT/US2013/027114, Daejeon Metropolitan City, South Korea, Jun. 21, 2013, pp. 1-3.

Written Opinion of the International Searching Authority for International Application No. PCT/US2013/027114, Daejeon Metropolitan City, South Korea, Jun. 21, 2013, pp. 1-8.

Office Action and English Translation issued Aug. 13, 2015 in corresponding Chinese Patent Application No. 201380020087.2; 23 pages.

* cited by examiner

CEMENTING WHIPSTOCK APPARATUS AND METHODS

CROSS-REFERENCE TO RELATED APPLICATIONS

This application claims the benefit of U.S. Provisional Patent Application Ser. No. 61/601,354, filed Feb. 21, 2012, which is incorporated herein by reference in its entirety. This application is a continuation-in-part of U.S. patent application Ser. No. 13/085,586 filed Apr. 13, 2011, which claims the benefit of U.S. Provisional Patent Application Ser. No. 61/325,068, filed Apr. 16, 2010.

BACKGROUND

One or more embodiments disclosed herein relate generally to whipstock systems and methods. In particular, one or more embodiments disclosed herein relate to whipstocks for sidetracking a borehole from a wellbore.

Traditionally, whipstocks have been used to drill deviated boreholes from an existing wellbore. A whipstock has a ramped surface that is set in a predetermined position to guide a drill bit or drill string in a deviated manner to drill into the side of the wellbore, which may also be called a sidetrack window or window. In operation, the whipstock is positioned/set on the bottom of the existing wellbore, the set position of the whipstock is then surveyed and the whipstock is properly oriented for directing the drill string in the proper direction. After the whipstock is set, a drill string is lowered into the well into engagement with the whipstock causing the drill string to drill a deviated borehole through a wall of the existing wellbore.

Other uses for whipstocks include sidetracking from previously drilled and cased/uncased wellbores that have become unproductive. For example, when a wellbore becomes unusable, a new borehole may be drilled in the vicinity of the existing cased or uncased wellbore or, alternatively, a new borehole may be sidetracked from the serviceable portion of the existing, cased or uncased wellbore. Sidetracking from a cased or uncased wellbore also may be useful for developing multiple production zones. This procedure can be accomplished by milling through the side of the casing and/or into the wellbore wall with a mill that is guided by a wedge or whipstock component. After a milling or drilling procedure is completed, the whipstock may be removed from the wellbore.

Cement plugs may be set in the wellbore in sidetracking operations to prevent hydrocarbons or other fluids from lower sections of the wellbore seeping up past the whipstock location. The cement plug is set below the whipstock to isolate lower sections of the wellbore. Typically, a cement plug may be set during a first trip into the wellbore, after which the whipstock may be run into the wellbore in a second trip. Accordingly, existing operations employ two or more trips downhole.

SUMMARY

A sidetracking system for forming a deviated wellbore is disclosed. The sidetracking system includes a whipstock assembly having a whipstock and a stinger assembly having a stinger extending at least partially through the whipstock assembly. The stinger is releasably coupled to the whipstock assembly by a latch mechanism, such as a collet. A ball seat carrier has an extended portion releasably coupled within an interior of the latch mechanism. The sidetracking system may also include an anchor assembly arranged and designed to anchor the whipstock assembly downhole, e.g., in an open hole. The sidetracking system enables setting/anchoring of the whipstock and creation of a cement plug, e.g., via the stinger, in a single trip downhole into the wellbore.

A method of drilling a deviated wellbore (e.g., sidetracking) is also disclosed. A sidetracking system is deployed downhole in a wellbore. The sidetracking system includes a whipstock assembly and a stinger assembly. The whipstock assembly has a portion of the stinger assembly extending at least partially therethrough. The portion of the stinger assembly has a latch mechanism, such as a collet, releasably coupling with a component of the sidetracking system. The latch mechanism releasably houses a ball seat carrier in an interior thereof. After deployment of the sidetracking system, a ball is launched into a central bore of the stinger assembly. Fluid is pumped down through the central bore to drive the ball into engagement with a ball seat of the ball seat carrier. Once seated, the ball at least partially occludes the central bore. The pumping of fluid into the central bore is continued to sufficiently increase fluid pressure therein to cause the ball seat carrier to be released from the latch mechanism. Prior to ball launch, the sidetracking system may be anchored at a desired location or position downhole, e.g., via the actuation of slips or the inflation of a packer.

A method for sidetracking is also disclosed. A sidetracking system is deployed downhole in a wellbore. The sidetracking system includes a whipstock assembly and a stinger assembly. The whipstock assembly has a portion of the stinger assembly extending at least partially therethrough. The portion of the stinger assembly has a latch mechanism, such as a collet, releasably coupling with a component of the sidetracking system. The latch mechanism releasably houses a ball seat carrier in an interior thereof. The sidetracking system is anchored at a desired depth, e.g., in an uncased wellbore. A ball is launched into the central bore of the stinger assembly. Fluid is pumped down through the central bore to drive the ball into engagement with a ball seat of the ball seat carrier. Once the ball is seated in engagement with the ball seat, the central bore is at least partially occluded. Continued pumping of fluid down into the central bore sufficiently increases fluid pressure therein to cause the ball seat carrier to be released from the latch mechanism. Once the ball seat carrier is released, pulling on the stinger assembly axially raises the stinger assembly a short distance. A cement-containing material may be pumped into the central bore of the stinger assembly to perform a cementing operation in the wellbore. In one or more embodiments, the anchoring of the sidetracking system and the pumping of the cement-containing material into the central bore of the stinger assembly occur during a single downhole trip.

In another embodiment, a method for drilling a deviated wellbore comprises deploying downhole a sidetracking system having a whipstock assembly and a stinger assembly. The whipstock assembly is arranged and designed to receive a portion of the stinger assembly at least partially therethrough and the stinger assembly has a central bore therethrough. The method further comprises decoupling the portion of the stinger assembly from a component of the sidetracking system via a releasable latch mechanism, such as a collet. The releasable latch mechanism is arranged and designed to releasably house a ball seat carrier in an interior thereof. The releasable latch mechanism permits decoupling of the portion of the stinger assembly from the member of the sidetracking system when no ball seat carrier is housed in the interior of the latch mechanism.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of the disclosed embodiments. However, it will be understood by those of ordinary skill in the art that the disclosed embodiments may be practiced without these details and that numerous variations or modifications may be possible without departing from the scope of the disclosure.

The disclosed embodiments generally relate to a system and method designed to facilitate sidetracking operations in which at least one lateral/deviated wellbore (i.e., borehole) is formed with respect to another wellbore, e.g., with respect to a vertical wellbore. Certain embodiments disclosed herein relate to a sidetracking system including a whipstock assembly combined with a stinger assembly having a stinger coupled to a sub of the sidetracking system by a releasable latch mechanism, such as a shear pin or collet. In some embodiments, the whipstock assembly has a central bore therethrough, and the sidetracking system also comprises an expandable anchor assembly configured to be hydraulically actuated and set at a specific depth in a wellbore. In some embodiments, the sidetracking system may further comprise a removable flow blocking member, e.g., a burst disc, to restrict a fluid flow and to increase a pressure in the central bore to actuate the expandable anchor, e.g., expandable slips and/or packer. The sidetracking system enables setting of the whipstock and creation of a cement plug in a single trip downhole into the wellbore.

Figure 1:
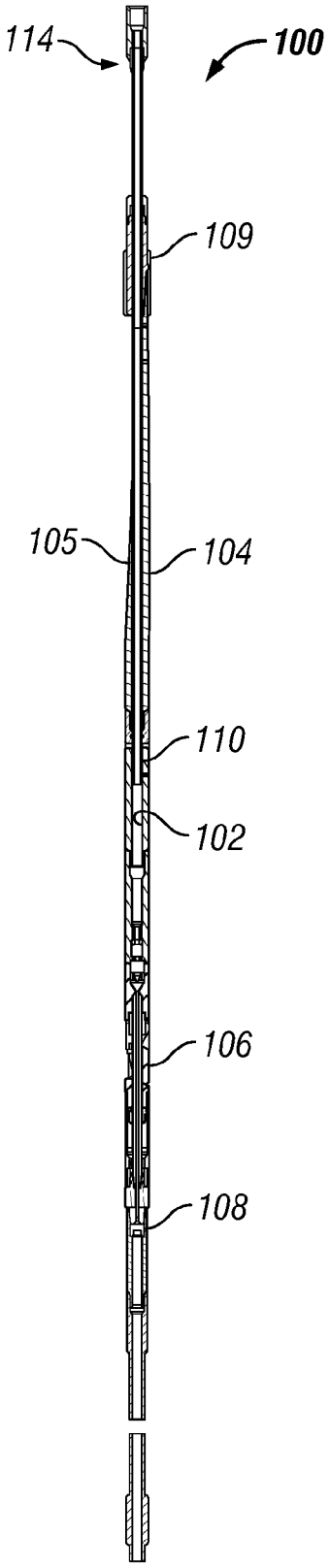
FIG. 1 is a cross-sectional view of a sidetracking system in accordance with embodiments of the present disclosure.
Figure 2:
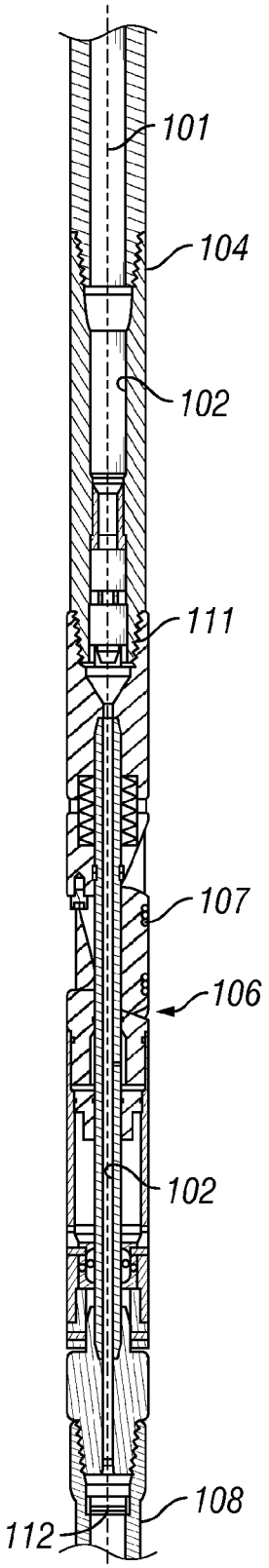
FIG. 2 is an enlarged cross-sectional view of a portion of the sidetracking system illustrated in FIG. 1.

Referring generally to FIGS. 1 and 2, cross-sectional views are provided of a sidetracking system 100 having a central bore 102 therethrough in accordance with embodiments of the present disclosure. In the embodiment illustrated, the sidetracking system 100 comprises a whipstock assembly 104 and an expandable anchor assembly 106 attached below the whipstock assembly. The whipstock assembly 104 comprises a sidetracking slide or ramp 105 formed to facilitate drilling of a sidetracked window (e.g., if sidetracking through a cased wellbore) and the drilling of the lateral/deviated wellbore (i.e., borehole). The whipstock assembly 104 may be oriented about a central axis 101 in any direction (i.e., 0° to 360°) so that a sidetracked wellbore (i.e., borehole) may be drilled in a desired direction.

The expandable anchor assembly 106 may be attached or coupled to the whipstock assembly 104 via a threaded connection 111. Alternatively, other types of connections also may be used. The expandable anchor assembly 106 comprises multiple slips 107 that may be expanded radially outward to engage a surrounding wellbore wall, such as a formation wall in an uncased hole or casing in a cased hole. Engagement of the slips 107 with the surrounding wellbore wall anchors the sidetracking assembly 100 at the desired location in the wellbore. The slips 107 may be hydraulically actuated by increasing the pressure on fluid within the central bore 102 to cause the slips 107 to expand radially outward. However, the slips 107 may be actuated by other techniques, e.g., mechanical actuation.

A sub 108 of the sidetracking system 100 may be constructed as a burst sub having a removable member, e.g., a burst disc 112. By way of example, the sub 108 may be attached to a lower end portion of the expandable anchor assembly 106. The burst disc 112 enables the increasing of pressure in the central bore 102 to actuate the expandable anchor assembly 106. In this example, the sub 108 contains any type of burst disc 112 or other type of pressure control device having a membrane or restriction configured to fail at a predetermined pressure. As an alternative, the sub 108 can contain a piston-type shear release mechanism or other suitable mechanism to release the pressure at a predetermined level.

Integration of the expandable anchor assembly 106 and the burst sub 108 with the whipstock assembly 104 enables the sidetracking system 100 to be located at any depth in a wellbore because the expandable anchor assembly 106 may be set at any desired location or wellbore depth. Thus, the sidetracking system 100 is capable being disposed in a wellbore at locations other than a bottom of the wellbore and other than the top of a stationary object, e.g., a "fish," in the wellbore.

Referring again to FIGS. 1 and 2, methods of using the sidetracking system 100 in accordance with embodiments disclosed herein include running the sidetracking system 100 into the wellbore to a specified location or depth of the wellbore. As the sidetracking system 100 is run into the wellbore, fluid is circulated above the whipstock assembly 104 through a pass valve (circulating valve) (not shown) for measurement-while-drilling ("MWD") purposes, e.g., to find a particular desired wellbore direction for sidetracking Physical properties of the sidetracking system, such as bore pressure, temperature and wellbore trajectory may be measured while running the sidetracking system 100 into the wellbore 116. Those skilled in the art will be familiar with MWD operations and methods of using the collected data to orient the sidetracking apparatus in the wellbore. Based on the MWD data taken from the wellbore, the whipstock assembly 104 may be oriented in a wellbore so the sidetracking ramp 105 faces a direction in which the sidetracked wellbore (i.e., borehole) will extend. In alternative embodiments, a gyro orienting system may be employed to orient the whipstock assembly 104 in the wellbore, e.g., in a vertical wellbore.

Subsequently, an operator may increase pressure in the central bore 102 of the sidetracking system 100 by pumping a fluid into the central bore 102 and/or by cycling pumps to close the bypass valve (not shown). In certain embodiments, the fluid may be a drilling fluid or mud. In alternative embodiments, the fluid used may be a separate actuation fluid from a separate fluid source. If a separate actuating fluid is used, the separate actuating fluid is isolated by, for example, a running tool and a running tool piston (not shown). The fluid flows down the central bore 102 to the burst disc 112 (or other blocking member), which prevents the fluid from flowing further and thus allows a pressure increase in the central bore 102. The pressure increase is used to hydraulically actuate the multiple slips 107 of the expandable anchor assembly 106. For example, the pressure causes slips 107 to radially expand and engage the surrounding wellbore wall. Depending on the type of anchor assembly 106, various hydraulic pressure increases may be applied in the central bore 102 to force the slips 107 into proper engagement with the surrounding wellbore wall and thus to set the expandable anchor assembly 106 at the desired wellbore location.

After slips 107 are radially expanded and engaged with the surrounding wellbore wall, e.g., the formation in an open/uncased hole, and the sidetracking system 100 is properly set in the wellbore, the burst disc 112 in burst sub 108 may be ruptured through application of additional pressure. This allows the cementing operation to commence to form a cement plug in the wellbore below the sidetracking system 100. In some applications, the burst disc 112 may be ruptured by exerting an axial force downward on the whipstock assembly 104 in a manner which causes shear pins 109 and 110 to fail. By way of example, shear pin 109 may be designed to fail first followed by failure of shear pin 110. As described in greater detail below, the shearing of shear pins 109, 110 (or release of other suitable release member 190 as disclosed with respect to FIGS. 12-15) may be used to release a running assembly, e.g., stinger assembly, 114 prior to pumping cement down through central bore 102. This ensures easy retrieval of the running assembly 114 following the cementing operation. The cementing operation is designed to form and set a cement plug in the wellbore below or adjacent the sidetracking system 100 to isolate a lower section of the wellbore from the sidetracking region at which the lateral/deviated wellbore (i.e., borehole) is formed. This is beneficial in uncased wellbores, because the cement plug mitigates formation fluid influx from formation(s) below the cement plug. Following cementing, a drill string having a drill bit is conveyed downhole into engagement with a whipstock 118 of the whipstock assembly 104. Once the drill string is downhole, the drilling operation may be commenced to form a sidetracked wellbore (i.e., borehole) with the aid of the whipstock assembly 104.

One or more embodiments of the present disclosure provide a sidetracking system that can simultaneously set a whipstock assembly and a cement plug in a single trip into the wellbore. The sidetracking system may be used at any location or depth of the wellbore, as opposed to conventional sidetracking devices that must be located either at a bottom of the wellbore or on top of a stationary object. In one or more embodiments, the sidetracking system is used in an open hole (i.e., an uncased wellbore). By decreasing the number of trips into the wellbore, the time and costs associated with drilling deviated wellbores is decreased.

Figure 3:
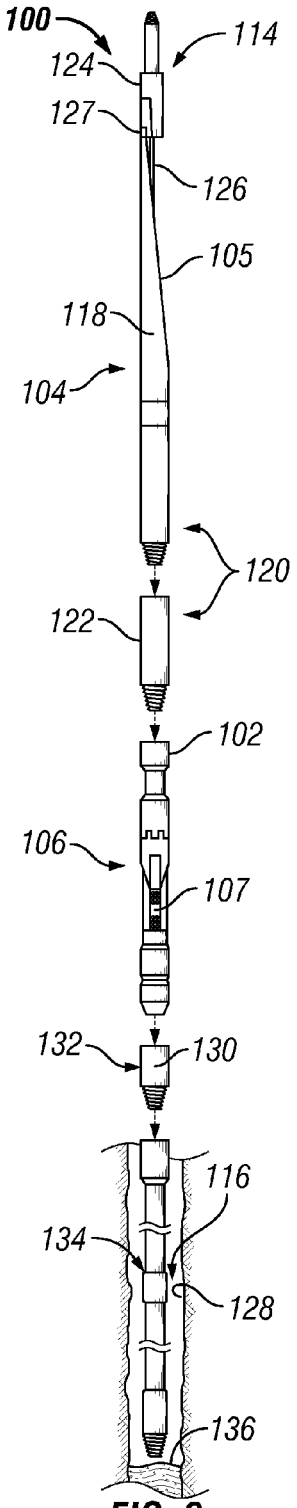
FIG. 3 is a schematic illustration of another example of a sidetracking system in accordance with embodiments of the present disclosure.

Referring generally to FIG. 3, another embodiment of the sidetracking system 100 is illustrated. In this embodiment, the sidetracking system 100 is illustrated as disposed in a wellbore 116. The sidetracking system 100 comprises whipstock assembly 104 having a whipstock 118 comprising the sidetracking slide or ramp 105. The whipstock assembly 104 also may comprise a variety of other components 120, such as an anchor spacer 122. The whipstock assembly 104 and the entire sidetracking system 100 may be conveyed downhole into the wellbore 116 via stinger assembly 114. In this embodiment, stinger assembly 114 comprises a setting tool 124 coupled to whipstock 118. The stinger assembly 114 also comprises a stinger 126 which extends down into whipstock assembly 104 to deliver a cement-containing material/slurry along the central bore 102 for forming the cement plug at a desired location along wellbore 116. The stinger assembly 114 is secured to whipstock assembly 104 or to another suitable component by a release mechanism 127, such as the shear pins 109 and/or 110 described with reference to FIG. 1. However, other types of release mechanisms 190 (FIG. 12), e.g., a collet, may be employed.

In this embodiment, the sidetracking system 100 further comprises expandable anchor 106 which may be coupled to anchor spacer 122 beneath whipstock assembly 104. The expandable anchor assembly 106 comprises expandable slips 107 which may be selectively expanded against a surrounding wall 128 of wellbore 116 to secure the sidetracking system 100 at a desired location along the wellbore 116. By way of example, the expandable slips 107 may be expanded hydraulically by pressurizing fluid within central bore 102 against a flow restriction member 130 which may be positioned in a burst sub 132. The flow restriction member 130 may comprise burst disc 112 (FIG. 2) or other suitable flow restriction members, such as a ball dropped onto a ball seat in the burst sub 132, as discussed in greater detail below. The burst sub 132 may be located below expandable anchor 106.

As illustrated, a tail pipe 134 may be positioned below expandable anchor 106 to direct cement slurry to the desired wellbore location for forming of a cement plug 136. By way of example, the tail pipe 134 is coupled to a lower end portion of the burst sub 132, although other components may be incorporated into this design. The length of tail pipe 134 may be selected according to the desired placement of cement plug 136. It should be noted, however, that sidetracking system 100 may have a variety of configurations and utilize a variety of components to place the cement plug 136 at other desired locations along wellbore 116. For example, sidetracking system 100 may be utilized to place the cement plug 136 at a bottom of the wellbore or at any of a variety of locations along wellbore 116 separate from the bottom of the wellbore 116.

In operation, the sidetracking system 100 illustrated in FIG. 3 is initially run in hole to a desired setting depth. The whipstock 118 is then oriented with a measurement-while-drilling system or a gyro system, as discussed above. Once oriented, pressure is increased along the central bore 102 to set the expandable anchor 106 which secures the sidetracking system 100 at the desired location along wellbore 116. After setting the expandable anchor 106, the pressure in central bore 102 is increased to fracture or otherwise remove the flow restriction member 130, thus allowing flow of cement slurry down through the sidetracking system 100.

The stinger assembly 114 is then disconnected from the whipstock assembly 104 by releasing the setting tool 124 from the whipstock 118. The release of setting tool 124 may be achieved by separating, e.g., shearing, release mechanism 127 which may be in the form of a suitable shear member, e.g., shear pins 109, 110. However, other types of release mechanisms 190, as described below, may be employed to enable selective separation of stinger assembly 114 from the portion of sidetracking system 100 which remains downhole. Following separation of the stinger assembly 114, cement is pumped down through stinger 126 and through the sidetracking system 100 to establish cement plug 136 at the desired location within wellbore 116. After the cement is pumped, the stinger assembly 114, including setting tool 124 and stinger 126, is tripped out of the hole and removed. At this stage, a drilling assembly may be conveyed downhole into engagement with whipstock 118 of whipstock assembly 104. The ramp 105 is designed to support the drilling assembly and to direct the drilling assembly laterally to facilitate sidetracking and formation of the desired lateral/deviated wellbore. By way of example, the ramp 105 of whipstock 118 may be concave and formed from a hard material, such as steel. The ramp 105 also may be angled at a desired angle, e.g., up to 3°, designed to achieve the planned sidetracking transition in forming the lateral/deviated wellbore.

Figure 4:
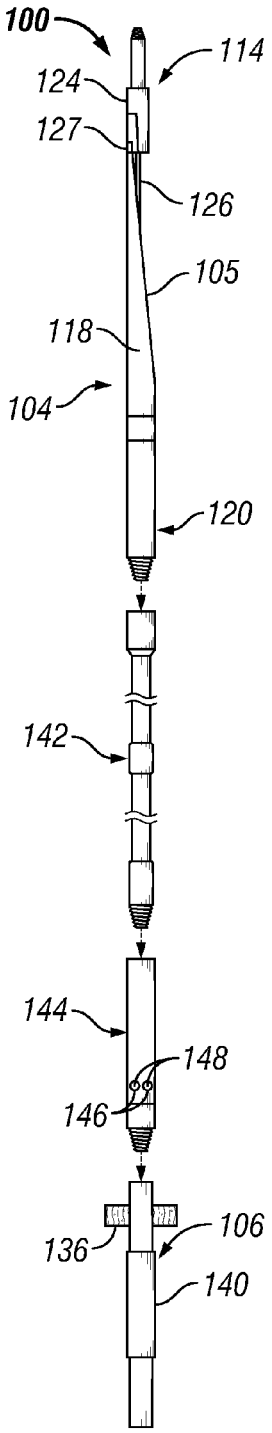
FIG. 4 is a schematic illustration of another example of a sidetracking system in accordance with embodiments of the present disclosure.

Referring generally to FIG. 4, another embodiment of the sidetracking system 100 is illustrated. In this embodiment, the sidetracking system 100 may again be disposed in wellbore 116. The sidetracking system 100 similarly comprises whipstock assembly 104 having whipstock 118 and sidetracking ramp 105. The whipstock assembly 104 and the entire sidetracking system 100 may be conveyed downhole into the wellbore 116 via stinger assembly 114. In this embodiment, stinger assembly 114 again comprises setting tool 124, coupled to whipstock 118, and stinger 126. Stinger 126 extends down into whipstock assembly 104 to deliver a cement slurry along the central bore 102 for forming the cement plug at a desired location along wellbore 116 (see FIG. 3). The stinger assembly 114 is secured to whipstock assembly 104 or to another suitable component by the release mechanism 127, e.g., a shear mechanism which may be in the form of shear pins 109 and/or 110. Release mechanism 190, as disclosed below with respect to FIGS. 12-15, may alternatively be employed.

In this embodiment, however, the expandable anchor 106 is in the form of a packer 140, such as an inflatable packer, positioned below whipstock assembly 104. The packer 140 is designed to seal against the surrounding wellbore wall 128 (see FIG. 3) to provide a platform on which cement plug 136 may be formed at a desired location above the bottom of wellbore 116 (see FIG. 3). In the specific example illustrated, the whipstock assembly 104 and packer 140 are separated by additional components, such as an intermediate tail pipe 142 and a circulation sub 144. The tail pipe 142 may be selected to facilitate positioning of the cement plug at a desired location/position along the wellbore 116 (see FIG. 3). The circulation sub 144 comprises one or more ports 146 through which cement slurry is expelled to create the cement plug 136. The ports 146 may initially be blocked by suitable blocking members 148, such as burst discs. It should be noted that expansion of packer 140 may be achieved according to a variety of methods depending on the specific type of packer selected. For example, the packer 140 may be a swell packer, a mechanically actuated packer, an inflatable packer, or other suitable seal members designed to form a seal between the sidetracking system 100 and the surrounding wellbore wall 128 (see FIG. 3). If pressurized fluid is needed to inflate packer 140, a burst sub 132 may be positioned below the packer or a ball and ball seat may be incorporated into the inflatable packer (not shown).

The embodiment illustrated in FIG. 4 provides reliable spotting of the cement plug location even when the cement plug is located significantly off-bottom. Furthermore, the packer 140 is able to provide additional isolation even if the cement plug 136 has integrity issues, e.g., honeycombing. This type of design also enables use of a shorter cement plug which, in turn, requires less tail pipe and less cement to create greater efficiencies with respect to the sidetracking operation.

In operation, the sidetracking system 100 illustrated in FIG. 4 is initially run in hole to a desired setting depth. The whipstock 118 is then oriented with a measurement-while-drilling system or a gyro system. Once oriented, the packer 140 is expanded against the surrounding wellbore wall. By way of example, a ball may be dropped to block flow along central bore 102 which allows the pressure to be increased to set an inflatable packer. Pressure is then increased further to open flow through ports 146 by, for example, fracturing blocking members 148, e.g., rupture discs.

The stinger assembly 114 is then disconnected from the whipstock assembly 104 by releasing the setting tool 124 from the whipstock 118. The release of setting tool 124 may be achieved by, for example, shearing the release member 127 which may be in the form of shear pins 109, 110. However, other types of release mechanisms 190 (FIGS. 12-15) may be employed to enable selective separation of stinger assembly 114 from the portion of sidetracking system 100 which remains downhole. Following separation of the stinger assembly 114, cement is pumped down through stinger 126 and through the sidetracking system 100 until flowing outwardly through ports 146 to a location above packer 140. This enables the cement plug 136 to be established at a location above the packer. After the cement is pumped, the stinger assembly 114, including setting tool 124 and stinger 126, is tripped out of the hole and removed. At this stage, a drilling assembly may be conveyed downhole to begin the sidetracking stage of operation in which the lateral/deviated wellbore is drilled.

Figure 5:
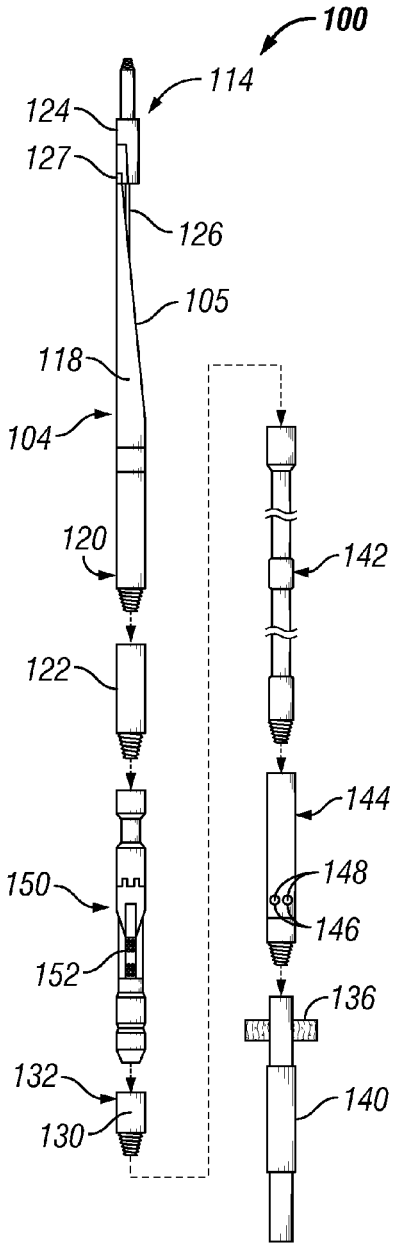
FIG. 5 is a schematic illustration of another example of a sidetracking system in accordance with embodiments of the present disclosure.
Figure 12:
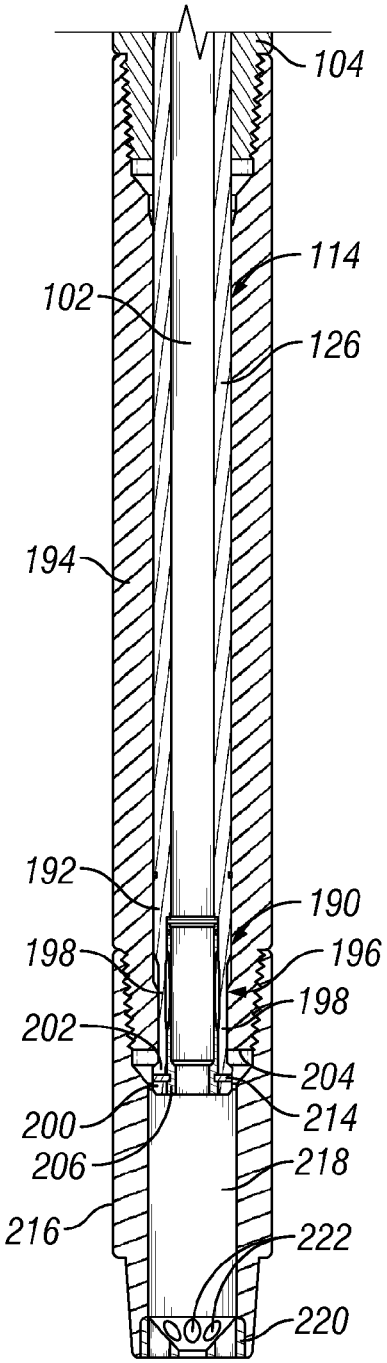
FIG. 12 is a cross-sectional view illustrating a stinger assembly coupled into the sidetracking system via a latch mechanism in accordance with one or more embodiments of the present disclosure.

Referring generally to FIG. 5, another embodiment of the sidetracking system 100 is illustrated. In this embodiment, the sidetracking system 100 may again be disposed in wellbore 116 (see FIG. 3). The sidetracking system 100 similarly comprises whipstock assembly 104 having whipstock 118 and sidetracking ramp 105. The whipstock assembly 104 and the entire sidetracking system 100 may be conveyed downhole into the wellbore 116 via stinger assembly 114 which comprises setting tool 124 and stinger 126. The stinger 126 again extends down into whipstock assembly 104 to deliver a cement slurry along the central bore 102 to form the cement plug at a desired location along wellbore 116 (see FIG. 3). The stinger assembly 114 may again be secured to whipstock assembly 104 or to another suitable component by the release mechanism 127, e.g., a shear mechanism which may be in the form of shear pins 109 and/or 110, or the release mechanism 190 (FIG. 12).

In this embodiment, however, the expandable packer 140, e.g., an inflatable packer, is combined with another expandable anchor 150. The expandable anchor 150 may be constructed in a variety of configurations, but one suitable embodiment utilizes a plurality of slips 152 which may be expanded against the surrounding wellbore wall 128 (see FIG. 3). Expandable anchor 150 may be similar to that described above with respect to the expandable anchor assembly 106 utilized in the embodiments of FIGS. 1-3. The packer 140 is designed to seal against the surrounding wellbore wall 128 to provide a platform on which cement plug 136 may be formed at a desired location above the bottom of wellbore 116. However, the additional expandable anchor 150 helps support the sidetracking system 100 at the desired location within wellbore 116.

In the specific example illustrated, the expandable anchor 150 is located below whipstock assembly 104 and separated from the whipstock assembly 104 by anchor spacer 122. The burst sub 132 with flow restriction member 130 may be positioned beneath the expandable anchor 150 and above inflatable packer 140. The expandable anchor 150 and packer 140 also may be separated by additional components, such as the intermediate tail pipe 142 and the circulation sub 144. The tail pipe 142 may be selected to facilitate positioning of the cement plug at a desired location along a wellbore 116 (see FIG. 3). As described above, the circulation sub 144 may comprise one or more ports 146 through which cement slurry is expelled to create the cement plug 136. The ports 146 may initially be blocked by suitable blocking members 148, such as burst discs. It should again be noted that expansion of packer 140 may be achieved according to a variety of methods depending on the specific type of packer selected. For example, the packer 140 may be a swell packer, a mechanically actuated packer, an inflatable packer, or other suitable seal member designed to form a seal between the sidetracking system 100 and the surrounding wellbore wall 128. If pressurized fluid is needed to inflate packer 140, a burst sub 132 may be positioned below the packer or a ball and ball seat may be incorporated into the inflatable packer.

The embodiment illustrated in FIG. 5 utilizes expandable anchor 150 to provide primary support, while the packer 140 can serve as a secondary supporting member. Furthermore, the packer 140 is able to provide additional isolation even if the cement plug 136 has integrity issues, e.g., honeycombing. This type of design also provides for reliable space out of the cement plug 136 especially when setting the plug off the bottom of the well. This design also enables use of a shorter cement plug which, in turn, requires less tail pipe and less cement to create greater efficiencies with respect to the sidetracking operation.

In operation, the sidetracking system 100 illustrated in FIG. 5 is initially run in hole to a desired setting depth. The whipstock 118 is then oriented with a measurement-while-drilling system or a gyro system. Once oriented, pressure is increased in central bore 102 to set the expandable anchor 150. After setting expandable anchor 150, the pressure is further increased to open flow through burst sub 132 by removing, e.g., fracturing, the flow restriction member 130. The packer 140 is then expanded against the surrounding wellbore wall by, for example, dropping a ball to block flow along central bore 102 which allows the pressure to be increased to set an inflatable packer. However, packer 140 may have a variety of other configurations and may be set according to other techniques. Pressure is then increased further to open flow through ports 146 by removing port blocking members 148, e.g., fracturing rupture discs.

The stinger assembly 114 is then disconnected from the whipstock assembly 104 by releasing the setting tool 124 from the whipstock 118. The release of setting tool 124 may be achieved by, for example, shearing the release member 127 which may be in the form of shear pins 109, 110. However, other types of release mechanisms 190 (FIG. 12) may be employed to enable selective separation of stinger assembly 114 from the portion of sidetracking system 100 which remains downhole. Following separation of the stinger assembly 114, cement is pumped down through stinger 126 and through the sidetracking system 100 until flowing outwardly through ports 146 to a location above packer 140. After the cement is pumped, the stinger assembly 114, including setting tool 124 and stinger 126, is tripped out of the hole and removed. At this point, a drilling assembly may be conveyed downhole to begin the sidetracking stage of operation in which the lateral/deviated wellbore is drilled. It should be noted that in each of these embodiments, the stinger assembly 114 is separated from the whipstock assembly 104 prior to pumping cement to create the cement plug 136. In many applications, this technique can be extremely helpful in avoiding retrieval problems with respect to the setting tool 124 and stinger 126.

The design, configuration and arrangement of components within each embodiment of the sidetracking system 100 can vary to suit the parameters or requirements of a given sidetracking operation. For example, a variety of burst subs 132 may be utilized for controlling flow of drilling fluid through the sidetracking system 100 and for controlling actuation of expandable anchors or other devices.

Figure 6:
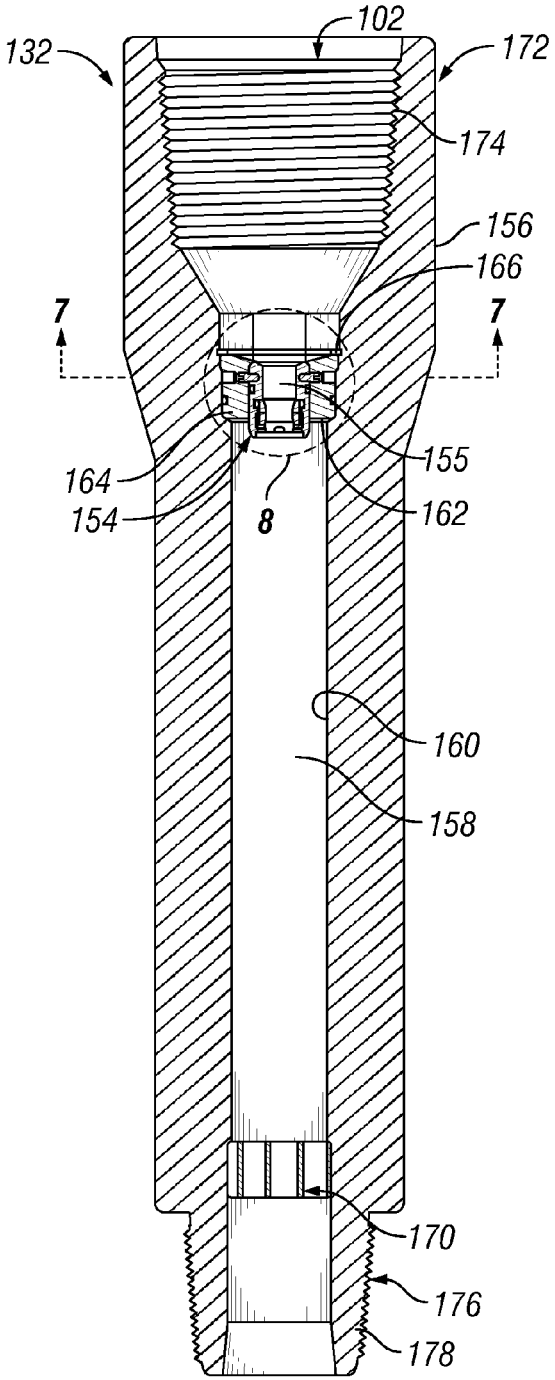
FIG. 6 is a cross-sectional view of a burst sub assembly which may be employed in a sidetracking system in accordance with embodiments of the present disclosure.
Figure 7:
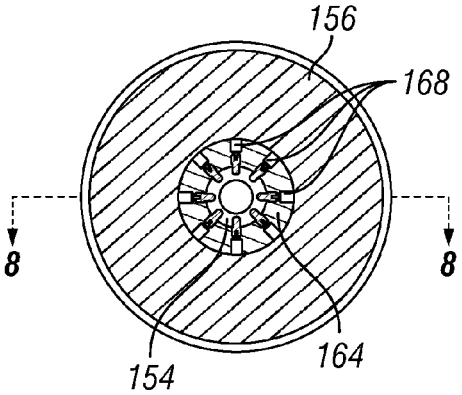
FIG. 7 is a cross-sectional view taken generally along line 7-7 of FIG. 6.
Figure 8:
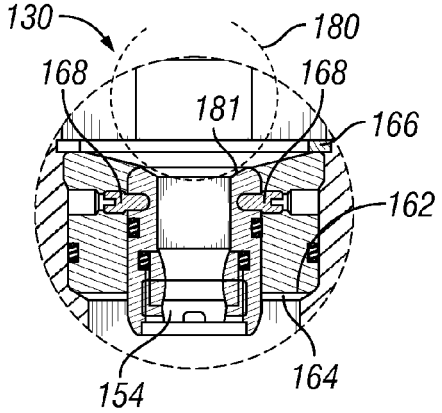
FIG. 8 is a cross-sectional view taken generally along line 8-8 of FIG. 7.

Referring generally to FIGS. 6-8, an alternative embodiment of burst sub 132 is illustrated. As described above, the burst sub 132 may incorporate a rupture or burst disc, such as burst disc 112 (FIG. 2). However, the embodiment illustrated in FIGS. 6-8 provides an alternative burst sub 132 which utilizes a ball drop shear barrel assembly 154 having an internal flow through passage 155. The burst sub 132 comprises a sub housing 156 having an internal flow path 158 which is part of the central bore 102 through which cement slurry may be passed.

The internal flow path 158 is defined by an internal surface 160 which is designed with a shoulder 162. The shoulder 162 receives a manifold 164 which carries the ball drop shear barrel assembly 154. The manifold 164 is secured against shoulder 162 by a retention ring 166, and the ball drop shear barrel assembly 154 is removably secured within manifold 164. In the example illustrated, the ball drop shear barrel assembly 154 is temporarily secured to manifold 164 by a plurality of shear members 168, as illustrated best in FIGS. 7 and 8. The shear members 168 may comprise shear screws threaded into ball drop shear barrel assembly 154.

As illustrated in FIG. 6, burst sub 132 further comprises a debris screen 170 positioned in internal flow path 158. The debris screen 170 may be sized to separate debris of a specific size. Additionally, the burst sub 132 may have a variety of connection end portions designed for engagement with other components of the sidetracking system 100. For example, an upper end portion of the sub 132 may be in the form of a box end portion 172 having an internal, threaded connector 174 designed for engagement with the lower end portion of expandable anchor 106, with expandable anchor 150, or with other system components. On an opposite end, the burst sub 132 may comprise a pin end portion 176 having an externally threaded connector 178 similarly designed for connection with adjacent components in a variety of embodiments of the sidetracking system 100.

In operation, the internal flow passage 155 of ball drop shear barrel assembly 154 may be left open during tripping of the sidetracking system 100 downhole to allow free flow of well fluid therethrough. As best shown in FIG. 8, once the system 100 is at the desired position and ready for increased pressure, a ball 180 is dropped onto an upper ball seat 181 of the ball drop shear assembly 154 to create flow restriction member 130, thereby enabling increased pressure along central bore 102 to actuate, for example, the expandable anchor. Subsequently, the pressure may be further increased to shear off shear members 168 so that ball 180 and ball drop shear barrel assembly 154 release and flow down through the sidetracking system to clear a path for the cement slurry used to form cement plug 136. In other embodiments, the ball drop shear barrel assembly 154 may incorporate a burst disc or other shear mechanism which fractures at a lower pressure than the shear members 168 to enable application of two different pressure levels.

Figure 9:
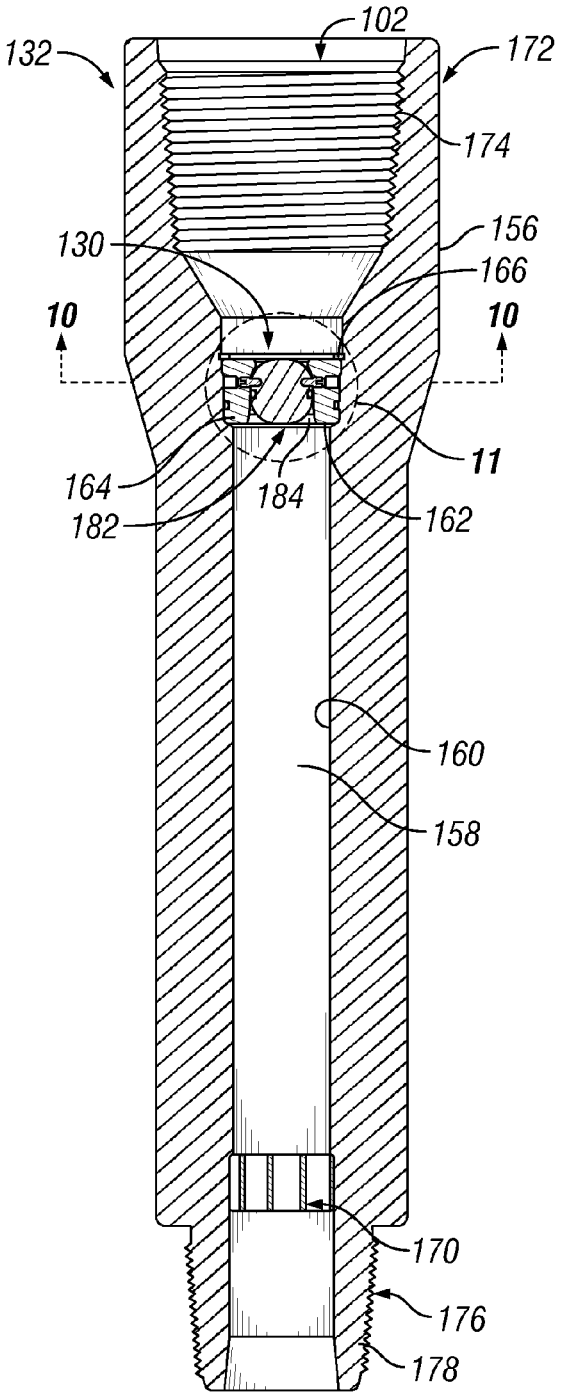
FIG. 9 is a cross-sectional view of another example of a burst sub assembly which may be employed in a sidetracking system in accordance with embodiments of the present disclosure.
Figure 10:
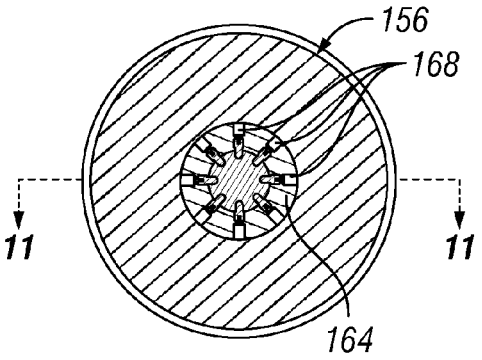
FIG. 10 is a cross-sectional view taken generally along line 10-10 of FIG. 9.
Figure 11:
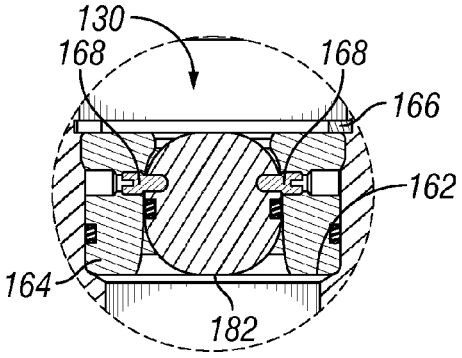
FIG. 11 is a cross-sectional view taken generally along line 11-11 of FIG. 10.

Referring generally to FIGS. 9-11, another alternative embodiment of burst sub 132 is illustrated. In this embodiment, many of the components are similar to components described with reference to FIGS. 6-8 and are labeled with the same reference numerals. The embodiment illustrated in FIGS. 9-11 provides an alternative burst sub 132 which utilizes flow restriction member 130 in the form of a barrel 182 which is secured within manifold 164 to block a flow path 184 through the manifold 164. In this similar embodiment, the burst sub 132 comprises sub housing 156 which includes internal flow path 158 as part of the central bore 102.

The internal flow path 158 is again defined by internal surface 160 having shoulder 162 to receive manifold 164 which is secured against shoulder 162 by retention ring 166. The barrel 182 is removably secured within manifold 164 by a plurality of shear members 168, as illustrated best in FIGS. 10 and 11. By way of example, the shear members 168 may comprise shear screws threaded into barrel 182.

In this latter embodiment, burst sub 132 also may comprise debris screen 170 positioned in internal flow path 158. The latter alternative embodiment of burst sub 132 also may have a variety of connection end portions designed for engagement with other components of the sidetracking system 100. For example, box end portion 172 may be located at an upper end portion of the burst sub 132, and pin end portion 176 may be located at a lower end portion of the burst sub.

In operation, the flow passage 184 within mandrel 164 is blocked by barrel 182 during tripping of the sidetracking system 100 downhole. Once the system 100 is at the desired wellbore position, pressure may be immediately increased to set the expandable anchor and/or other components. Subsequently, the pressure may be further increased to shear off shear members 168 so that the barrel 182 is removed to provide a path for the cement slurry used to form cement plug 136.

In some embodiments, the stinger assembly 114 may be coupled to a component or member (i.e., sub) of the sidetracking system 100 by a releasable latch mechanism, e.g., a collet, to insure against inadvertent separation of the stinger assembly 114 with respect to the whipstock assembly 104 during deployment of the sidetracking system 100 downhole. By way of example, such a releasable latch mechanism may be used in addition to or in place of shear members, such as shear pins 109, 110. Use of the releasable latch mechanism enables, for example, freeing of a stuck sidetracking system during deployment without fear of inadvertent separation of stinger assembly 114 from whipstock assembly 104 due to the breaking of a shear member 109, 110 solely securing the stinger assembly 114 within the sidetracking system 100. The releasable latch mechanism permits a substantial amount of overpull, e.g., five to six times normal shear values of shear members, to overcome any downhole sticking forces that may be experienced by the sidetracking system during deployment and/or operation.

Figure 13:
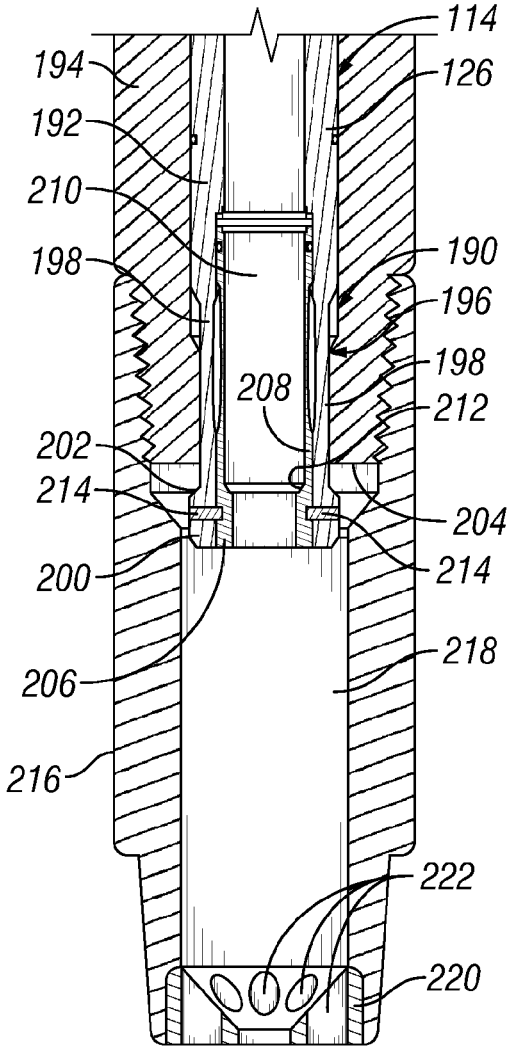
FIG. 13 is a cross-sectional view illustrating an enlarged view of the latch mechanism illustrated in FIG. 12.

Referring generally to FIGS. 12 and 13, an example of a system incorporating a releasable latch mechanism 190 is illustrated. In this embodiment, releasable latch 190 may be part of (i.e., integral with) and/or coupled to stinger 126 of stinger assembly 114. By way of example, the releasable latch mechanism 190 may be disposed or mounted at a distal end portion 192 of stinger 126, i.e., a lead end portion of the stinger 126. The latch mechanism 190 is designed to releasably engage an adjacent, e.g., surrounding, sub 194 of the sidetracking system 100. Sub 194 may serve as a latch sub and may be coupled to a downhole end portion of whipstock assembly 104 or to another suitable component of sidetracking system 100.

By way of example, releasable latch mechanism 190 may comprise a collet 196 having a plurality of flexible fingers 198. Each of the fingers 198 comprises a radially expanded portion 200 with an engagement surface 202, as best illustrated in FIG. 13. The engagement surfaces 202 may abut against corresponding engagement surfaces 204 of sub 194 prior to release of stinger 126 from sub 194 of system 100.

In the specific embodiment illustrated, a ball seat carrier 206 is initially housed by releasable latch 190, e.g., by collet 196. For example, the ball seat carrier 206 may comprise an extended portion 208 releasably housed/coupled within an interior of releasable latch 190. Extended portion 208 is arranged and designed to hold fingers 198 and radially expanded portion 200 in a radially outward position so that engagement surfaces 202 may remain in abutting engagement with (or be axially captured by) corresponding engagement surfaces 204 until the stinger 126 is released. As shown in FIGS. 12 and 13, engagement surface 202 is not in abutting engagement with corresponding engagement surface 204 but will be in abutting engagement when stinger 126/releasable latch mechanism 190 is moved axially upward relative to latch sub 194 (e.g., when the sidetracking system 100 is being held or lowered downhole from the surface). Ball seat carrier 206 remains engaged within collet 196 while the sidetracking system 100 is deployed downhole to ensure there is no inadvertent separation of the stinger assembly 114 from sub 194. The illustrated ball seat carrier 206 comprises an internal flow passage 210 extending past a ball seat 212. By way of example, the ball seat carrier 206 may be temporarily secured/coupled to collet 196 by a shear member 214, e.g., one or more shear screws.

Depending on the application and structure of the overall sidetracking system 100, additional or alternative components may be used in combination with the releasable latch mechanism 190. For example, a catch sub 216 may be coupled to sub 194 to provide a catch area 218 for ball seat carrier 206. In the example illustrated, a debris screen 220 is disposed within catch sub 216. When ball seat carrier 206 is released from collet 196, the ball seat carrier 206 can rest on debris screen 220. Debris screen 220 comprises a plurality of flow passages 222 which enable material, e.g., cement slurry, to flow through catch area 218 and catch sub 216 even when ball seat carrier 206 rests against the debris screen 220.

Releasable latch mechanism 190 may be located at a variety of positions along stinger assembly 114 and along the overall sidetracking system 100. In at least some embodiments, a portion of the stinger assembly 114 (i.e., stinger 126) extends through at least a portion of whipstock assembly 104 and is held captive with respect to the whipstock assembly 104 by the releasable latch mechanism 190 located at distal end portion 192. In the illustrated example, the stinger 126 extends through whipstock assembly 104 so that releasable latch mechanism 190 can releasably engage sub 194 which is positioned below whipstock assembly 104. The sub 194 can be directly or indirectly coupled with the whipstock assembly 104. By way of further example, latch sub 194 and catch sub 216 can replace anchor spacer 122 in the embodiments illustrated in FIG. 3 or FIG. 5. The latch sub 194 also can be positioned directly below component 120 in the embodiment illustrated in FIG. 4. However, the sub 194 potentially can be located at other positions along sidetracking system 100 depending on the specific design of the overall system 100 and of the releasable latch mechanism 190.

In operation, the sidetracking system 100 is deployed downhole into the wellbore 116 with releasable latch mechanism 190 in releasable engagement with (or axially captured by) sub 194. For example, engagement surface 202 of collet 196 may be securely held in abutting engagement with corresponding engagement surface 204 of sub 194. The ball seat carrier 206 is disposed within the interior of collet 196 so that collet fingers 198 are not able to flex inwardly to release engagement surface 202 from (or from being abutted against) corresponding engagement surface 204. This ensures that substantial tensile forces can be applied to the sidetracking system without causing inadvertent release of the stinger assembly 114. During deployment downhole, the ball seat carrier 206 is securely held in place via shear member 214.

Figure 14:
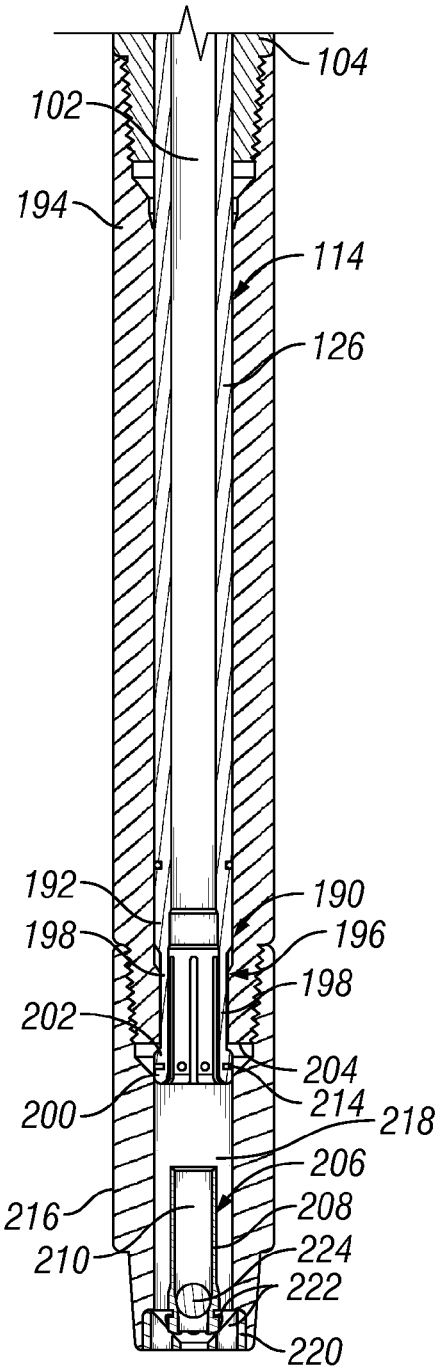
FIG. 14 is a cross-sectional view similar to that of FIG. 12 but showing the latch mechanism separated from a ball drop carrier in accordance with embodiments of the present disclosure.

Once the sidetracking system 100 is anchored at a desired depth, a ball 224 (not shown) is dropped down (i.e., launched) through central bore 102 and pumped by fluid through the sidetracking system 100, including through stinger 126, until landing on ball seat 212 of ball seat carrier 206. The ball 224, once landed and engaged on ball seat 212, at least partially occludes the internal flow passage 210 of ball seat carrier 206 (i.e., the central bore 102 of sidetracking system 100). The pump down pressure against the ball 224 is increased until shearing of shear member 214 occurs, thus allowing ball seat carrier 206 to be driven from the interior of collet 196, as illustrated in FIG. 14. In this example, the ball seat carrier 206 is designed to rest against debris screen 220 within catch area 218. It should be noted that ball 224 may comprise a variety of drop members formed in a variety of shapes and configurations, including spherical balls, partially spherical balls, darts and other types of drop members.

Figure 15:
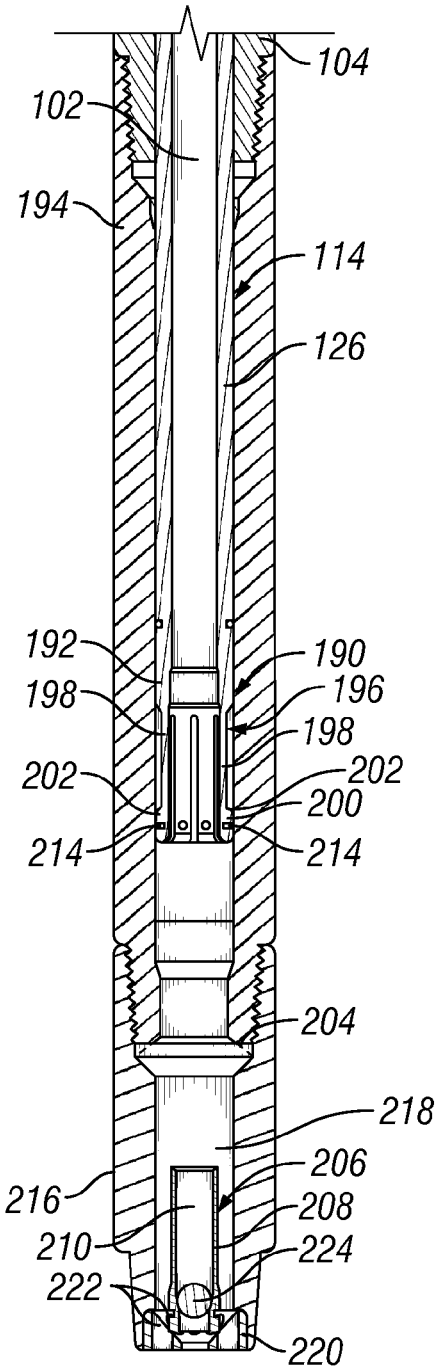
FIG. 15 is a cross-sectional view similar to that of FIG. 12 but showing the stinger assembly being withdrawn in accordance with one or more embodiments of the present disclosure.

After ball seat carrier 206 is removed from collet 196, collet fingers 198 can flex inwardly to release stinger 126. For example, upward tension on stinger assembly 114 causes engagement surface 202 of each collet finger 198 to slide inwardly with respect to the corresponding engagement surface 204 until the collet fingers 198 flex inwardly a sufficient amount to release the collet, as illustrated in FIG. 15. This effectively decouples the stinger assembly 114 from the latch sub 94 and the whipstock assembly 104 and allows the stinger 126 to be shifted linearly/axially with respect to the remaining sidetracking system 100. This decoupling of the latch mechanism 190, however, is arranged and designed only to occur when the ball seat carrier 206 is not present in the interior of the latch mechanism 190/collet 196.

During a cementing application, for example, removal of the ball seat carrier 206 from collet 196 is followed by applying overpull to shift/translate the stinger 126 upwardly a short distance, e.g., 20 to 40 cm. This provides surface confirmation that the stinger 126 is free from the whipstock assembly 104/sidetracking assembly 100 before cement is pumped downhole. The cement-containing material, e.g., cement slurry, may then be pumped down through stinger 126, as in the embodiments described above. Once the cementing is completed, the stinger assembly 114 and its stinger 126 may be pulled upwardly through the whipstock assembly 104 and removed from the wellbore.

It should be noted that many cementing applications utilize an anchor assembly 106 which may be set prior to releasing stinger 126 via releasable latch 190. The anchor assembly 106 may be set according to a variety of techniques as described above. In one example, however, a smaller anchor setting ball 180 is initially dropped down through stinger assembly 114, through sub 194, through ball seat 212, and through debris screen 220 until coming to rest on shear barrel assembly 154 (see FIG. 6). The smaller ball 180 creates a flow restriction so that pressure may be sufficiently increased along the central bore 102 to actuate the anchor assembly 106, thus anchoring sidetracking system 100 in the wellbore. As described above, the pressure may be further increased to cause shearing and release of the shear barrel assembly 154.

Upon anchoring the sidetracking system 100, the larger ball 224 is dropped and pumped along the central bore 102 until coming to rest against ball seat 212 of ball seat carrier 206. Because ball 224 is larger in diameter than anchor assembly actuating ball 180, the ball 224 is not able to pass through ball seat 212. Pressure applied against ball 224 may be used to remove ball seat carrier 206, thus enabling release of stinger 126 and performance of the cementing application as described above.

The various embodiments described herein may be constructed with many types of components arranged in a variety of configurations to facilitate a given downhole application. For example, additional types of flow control subs 132 may be incorporated into the sidetracking system 100. Similarly, different numbers of expandable anchors and flow control subs may be employed depending on the requirements of a given application and on the number of tools to be actuated in preparing the well for a sidetracking operation. Various seal members, e.g., inflatable packers, may be employed to facilitate creation of cement plugs at many locations along the wellbore above the bottom of the wellbore. However, other sidetracking applications may benefit from creating a cement plug at the bottom of the wellbore 116. In some applications, the system enables cementing and drilling of the lateral/deviated wellbore (i.e., borehole) at substantially the same time. By way of further example, the cement slurry may be delivered to fill a region surrounding at least a portion of the whipstock 118. The components and configurations of the sidetracking system 100 can be adjusted accordingly to accommodate these various sidetracking applications.

Although only a few embodiments have been described in detail above, those of ordinary skill in the art will readily appreciate that many modifications are possible without materially departing from the teachings of this disclosure. Accordingly, such modifications are intended to be included within the scope of this disclosure.

The invention claimed is:

1. A sidetracking system for forming a deviated wellbore, comprising:

a whipstock assembly having a whipstock;

a latch sub below the whipstock assembly;

a stinger assembly having a stinger extending fully through the whipstock assembly, a releasable connection between the stinger and the whipstock assembly consisting of a connection between a latch mechanism of the stinger assembly and the latch sub, the latch mechanism arranged and designed to allow the stinger assembly to translate axially while being held captive relative the whipstock; and a ball seat carrier having an extended portion releasably coupled within an interior of the latch mechanism.

2. The sidetracking system of claim 1, wherein the latch mechanism is arranged and designed to be releasable only when the ball seat carrier is not present in the interior of the latch mechanism.

3. The sidetracking system of claim 1, wherein the ball seat carrier is coupled to the interior of the latch mechanism by a shear member.

4. The sidetracking system of claim 1, further comprising an anchor assembly coupled to the whipstock assembly.

5. The sidetracking system of claim 4, wherein the anchor assembly is arranged and designed to anchor the whipstock assembly in an open hole.

6. The sidetracking system of claim 1, wherein the latch mechanism is a collet.

7. The sidetracking system of claim 1, further comprising a debris screen positioned downhole of the ball seat carrier and configured to catch the ball seat carrier when released from the interior of the latch mechanism.

8. The sidetracking system of claim 1, wherein the ball seat carrier is released after a ball launched from an uphole location seats on a ball seat disposed in the ball seat carrier.

9. A method of drilling a deviated wellbore, comprising:

deploying a sidetracking system downhole in a wellbore; the sidetracking system including a whipstock assembly and a stinger assembly; the whipstock assembly having a portion of the stinger assembly extending fully therethrough; the portion of the stinger assembly including a releasable connection with the whipstock assembly, the releasable connection consisting of a latch mechanism of the stinger assembly releasably coupling with a component of the sidetracking system that is below the whipstock assembly; the latch mechanism releasably housing a ball seat carrier in an interior thereof;

launching a ball into a central bore of the stinger assembly of the sidetracking system;

pumping fluid down through the central bore to drive the ball into engagement with a ball seat of the ball seat carrier; the ball seated in engagement with the ball seat at least partially occluding the central bore;

continuing to pump fluid down into the central bore to sufficiently increase fluid pressure therein to cause the ball seat carrier to be released from the latch mechanism; and pulling on the stinger assembly after the ball seat carrier is released to disengage the latch mechanism from the component of the sidetracking system.

10. The method of claim 9, wherein the latch mechanism is a collet.

11. The method of claim 10, wherein pulling on the stinger assembly after the ball seat carrier is released causes fingers of the collet to flex radially inward to disengage the latch mechanism from the component of the sidetracking system.

12. The method of claim 11, further comprising pumping a cement-containing material into the central bore of the stinger assembly.

13. The method of claim 9, further comprising anchoring the sidetracking system at a desired depth.

14. The method of claim 13, wherein anchoring the sidetracking system includes inflating a packer coupled to the whipstock assembly.

15. The method of claim 13, wherein anchoring the sidetracking system includes actuating at least one slip.

16. A method for sidetracking, comprising:

deploying a sidetracking system downhole in a wellbore; the sidetracking system including a whipstock assembly and a stinger assembly; the whipstock assembly having a portion of the stinger assembly extending fully therethrough; the portion of the stinger assembly including a releasable connection with the whipstock assembly, the releasable connection consisting of a latch mechanism of the stinger assembly releasably coupling with a component of the sidetracking system that is below the whipstock assembly; the latch mechanism releasably housing a ball seat carrier in an interior thereof;

anchoring the sidetracking system at a desired depth;

launching a ball into a central bore of the stinger assembly of the sidetracking system;

pumping fluid down through the central bore to drive the ball into engagement with a ball seat of the ball seat carrier; the ball seated in engagement with the ball seat at least partially occluding the central bore;

continuing to pump fluid down into the central bore to sufficiently increase fluid pressure therein to cause the ball seat carrier to be released from the latch mechanism;

pulling on the stinger assembly after the ball seat carrier is released to release the latch mechanism and axially raise the stinger assembly a short distance; and pumping a cement-containing material into the central bore of the stinger assembly to perform a cementing operation in the wellbore.

17. The method of claim 16, wherein the latch mechanism is a collet having a plurality of collet fingers.

18. The method of claim 16, wherein anchoring the sidetracking system includes at least one of:

actuating at least one slip; or inflating a packer mounted to the whipstock assembly.

19. The method of claim 16, further comprising withdrawing at least the portion of the stinger assembly from the wellbore.

20. The method of claim 16, wherein the anchoring of the sidetracking system and the pumping of the cement-containing material into the central bore of the stinger assembly occur during a single downhole trip.

21. A method for drilling a deviated wellbore, comprising:

deploying a sidetracking system having a whipstock assembly and a stinger assembly; the whipstock assembly arranged and designed to receive a portion of the stinger assembly fully therethrough; the stinger assembly having a central bore therethrough; and decoupling the portion of the stinger assembly from sidetracking system, the decoupling including releasing a connection consisting of an engagement of a releasable latch mechanism of the stinger assembly from a component of the sidetracking system located below the whipstock assembly, the releasable latch mechanism arranged and designed to releasably house a ball seat carrier in an interior thereof; the releasable latch mechanism permitting axial translational movement of the stinger assembly relative to the whipstock assembly while coupled to the component of the sidetracking system and permitting decoupling of the portion of the stinger assembly from the member of the sidetracking system when no ball seat carrier is housed in the interior of the latch mechanism.

* * * * *